US005092803A

United States Patent [19]

Johnson

[11] Patent Number: 5,092,803

[45] Date of Patent: Mar. 3, 1992

[54] METHOD AND APPARATUS FOR FORMING A SPARK PLUG

[75] Inventor: C. Earl Johnson, Riddely, Ill.

[73] Assignee: Energy Performance, Inc., Winter Haven, Fla.

[21] Appl. No.: 661,114

[22] Filed: Feb. 27, 1991

[51] Int. Cl.[5] ..... H01T 21/02

[52] U.S. Cl. ..... 445/7; 445/60

[58] Field of Search ..... 445/7, 60

[56] References Cited

U.S. PATENT DOCUMENTS

| | | | |
|---|---|---|---|
| 215,539 | 5/1879 | Peters | 72/325 |
| 376,914 | 1/1888 | Russell | 72/325 |
| 1,538,870 | 5/1925 | Champion | 313/140 |
| 2,193,886 | 3/1940 | Schulz | 72/316 |
| 2,367,445 | 1/1945 | Stoltenberg | 445/7 |
| 2,437,205 | 3/1948 | Middleton et al. | 445/7 |
| 2,487,535 | 11/1949 | Fernandez | 313/141 |
| 2,503,194 | 4/1950 | Cipriani et al. | 313/134 |
| 2,894,162 | 7/1959 | Ignatjev | 313/141 |
| 4,268,774 | 5/1981 | Forkum, Jr. | 313/141 |
| 4,916,354 | 4/1990 | Forkum, Jr. | 313/141 |

*Primary Examiner*—Richard K. Seidel
*Assistant Examiner*—Jeffrey T. Knapp
*Attorney, Agent, or Firm*—Shlesinger, Arkwright & Garvey

[57] ABSTRACT

A preferred embodiment includes a spark plug supporting assembly for supporting a spark having a longitudinal axis such that the gap-defining end of the ground electrode of the spark plug extends substantially perpendicular to the longitudinal axis. A blade assembly is operably associated with the spark plug supporting assembly for splitting the gap-defining end of the ground electrode into at least first and second prongs of substantially equal size. The blade assembly includes a blade member having a longitudinal axis oriented substantially perpendicular to the longitudinal axis of the spark plug. An actuating member is operably associated with the blade assembly to displace the same between a storage position and an operating position while the gap-defining end of the ground electrode is positioned substantially perpendicular to the longitudinal axis of the spark plug.

20 Claims, 4 Drawing Sheets

A
B
16
8
12
4
2
C
22
24
10
59
28
18
26
17
58
52
30
D
48
60
44
20
42
E
50
54
46
65
40

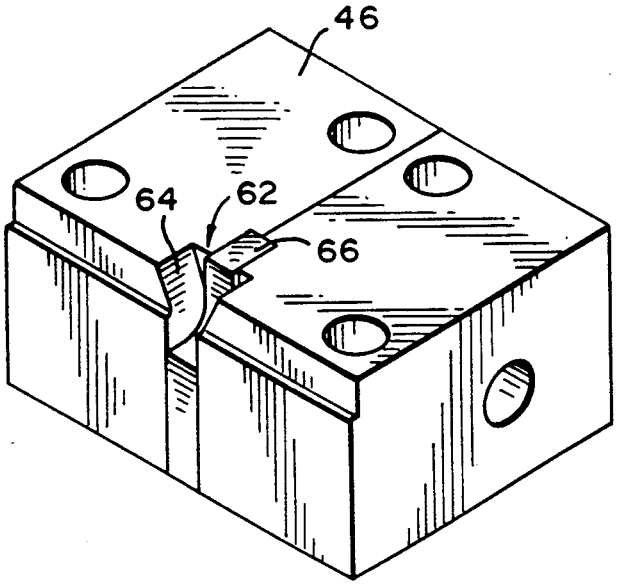
FIG_4
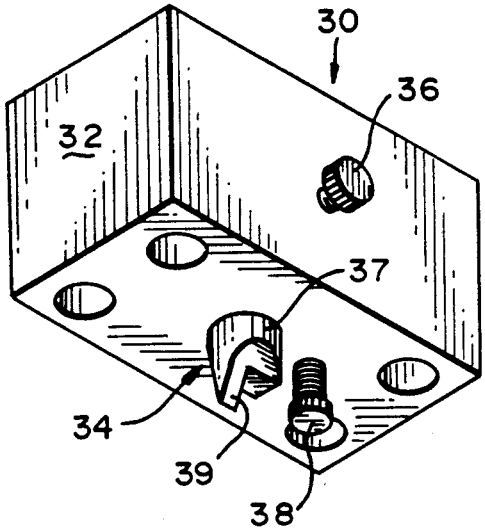
FIG_5
FIG_6
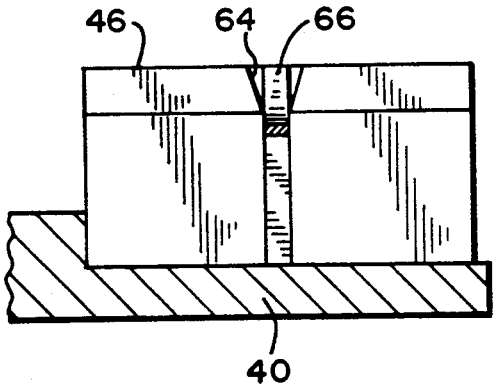
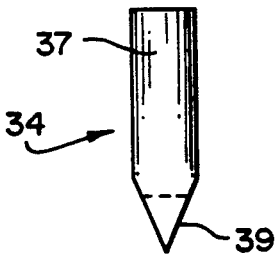
FIG_7

METHOD AND APPARATUS FOR FORMING A SPARK PLUG

FIELD OF THE INVENTION

The present invention is directed to method and apparatus for forming spark plugs. More specifically, a preferred embodiment of the present invention is directed to method and apparatus for forming the gap-defining end of a ground electrode of a spark plug with a substantially V-shaped configuration.

BACKGROUND OF THE INVENTION

It has previously been proposed to provide the gap-defining end of a ground electrode of a spark plug for internal combustion engines with two angularly spaced apart non-parallel prongs or arm portions, see U.S. Pat. Nos. 4,268,774 and 4,916,354. The prongs or arm portions are joined together at a base or vertex region to define a generally V-shaped configuration. The V-shaped prong configuration is so arranged and oriented relative to the center electrode of the spark plug to permit a spark to jump the gap between the center electrode and the ground electrode at the base or vertex region where the two prongs join together. Subsequently, the spark simultaneously travels along the two prongs. This simultaneous travel of the spark along the two angularly spaced apart non-parallel prongs is believed to be a major contributing factor to better mileage, less pollution in the engine exhaust and reduced carbon build-up on the electrodes.

However, previously known methods for forming spark plugs with ground electrodes of the type identified above are labor intensive and time consuming. Specifically, some previously known methods of forming the substantially V-shaped configuration in the gap-defining end of the ground electrode have required that the ground electrode first be straightened. Subsequently, the ground electrode is split into the two prongs. Once the two prongs are formed into the substantially V-shaped configuration, a corresponding portion of the ground electrode is bent over to form the gap-defining end. This method of forming the gap-defining end of the ground electrode is undesirable for a number of reasons. In this regard, it is noted that the additional bending steps can significantly weaken the ground electrode. Further, these additional bending steps significantly increase the time of manufacture.

OBJECTS AND SUMMARY OF THE INVENTION

It is an object of the present invention to provide method and apparatus for forming the gap-defining end of a ground electrode of a spark plug for an internal combustion engine with a substantially V-shaped configuration which eliminates at least one of the disadvantages associated with previously known devices and methods.

Another object of the present invention is to provide method and apparatus which simultaneously splits and shapes the gap-defining end of a ground electrode to form a substantially V-shaped configuration therein.

A further object of the present invention is to provide method and apparatus for forming the gap defining end of a ground electrode with a substantially V-shaped configuration while the gap defining end extends substantially perpendicular to the center electrode.

Yet another object of the present invention is to provide method and apparatus which are able to receive a conventional spark plug and form a substantially V-shaped configuration in the gap-defining end of the ground electrode without bending the ground electrode in any manner.

Still yet another object of the present invention is to provide method and apparatus for forming a substantially V-shaped configuration in the gap-defining end of a ground electrode which can readily accommodate varying size spark plugs.

Still a further object of the present invention is to provide method and apparatus for precisely orienting the vertex of the V-shaped gap defining end of the ground electrode relative to a predetermined portion of the center electrode.

Yet another object of the present invention is to provide method and apparatus which can readily vary the position of the vertex of the V-shaped gap-defining end of the ground electrode relative to a predetermined portion of the center electrode.

A further object of the present invention is to provide method and apparatus for forming the gap-defining end of the ground electrode with two linearly extending prongs of substantially equal size.

Still a further object of the present invention is to provide method and apparatus for mass producing spark plugs having a substantially V-shaped gag-defining end of a ground electrode from a conventional spark plug.

Yet a further object of the present invention is to provide method and apparatus for forming the gap-defining end of the ground electrode with a substantially V-shaped configuration while avoiding unwanted deformation in the ground electrode.

Another object of the present invention is to provide an apparatus for forming a substantially V-shaped configuration is the gap-defining end of the ground electrode which can be readily disassembled to facilitate servicing and/or storage of the same.

Yet another object of the present invention is to provide method and apparatus for forming a substantially V-shaped configuration in the gap-defining end of the ground electrode which permits a spark plug to be placed on or removed from a supporting member without tightening or loosening clamping devices and the like.

These objects and advantages of the present invention as well as others will be readily apparent from a review of the specification, claims and accompanying drawings.

In summary, the present invention is directed to method and apparatus for forming a spark plug. A preferred embodiment of the present invention includes a spark plug supporting assembly for supporting a spark plug such that the gap-defining end of the ground electrode extends substantially perpendicular to the longitudinal axis of the spark plug. A blade assembly is operably associated with the spark plug supporting assembly for splitting the gap-defining end of the ground electrode into at least first and second prongs of substantially equal size. The blade assembly includes a blade member having a longitudinal axis oriented substantially perpendicular to the longitudinal axis of the spark plug. An actuating member displaces the blade assembly between a storage position and an operating position while the gap-defining end of the ground electrode is positioned substantially perpendicular to the longitudinal axis of the spark plug.

DETAILED DESCRIPTION OF THE DRAWINGS

FIG. 4 is a perspective view of the die of the spark plug supporting assembly.

FIG. 5 is a perspective view of a portion of the blade assembly.

FIG. 6 is a fragmentary sectional view of a portion of the spark plug supporting assembly.

FIG. 7 is a side elevational view of the blade member of the blade assembly.

DETAILED DESCRIPTION OF THE INVENTION

The preferred embodiment of the present invention will be described hereinafter with reference made to FIGS. 1 through 7.

Figure 1:
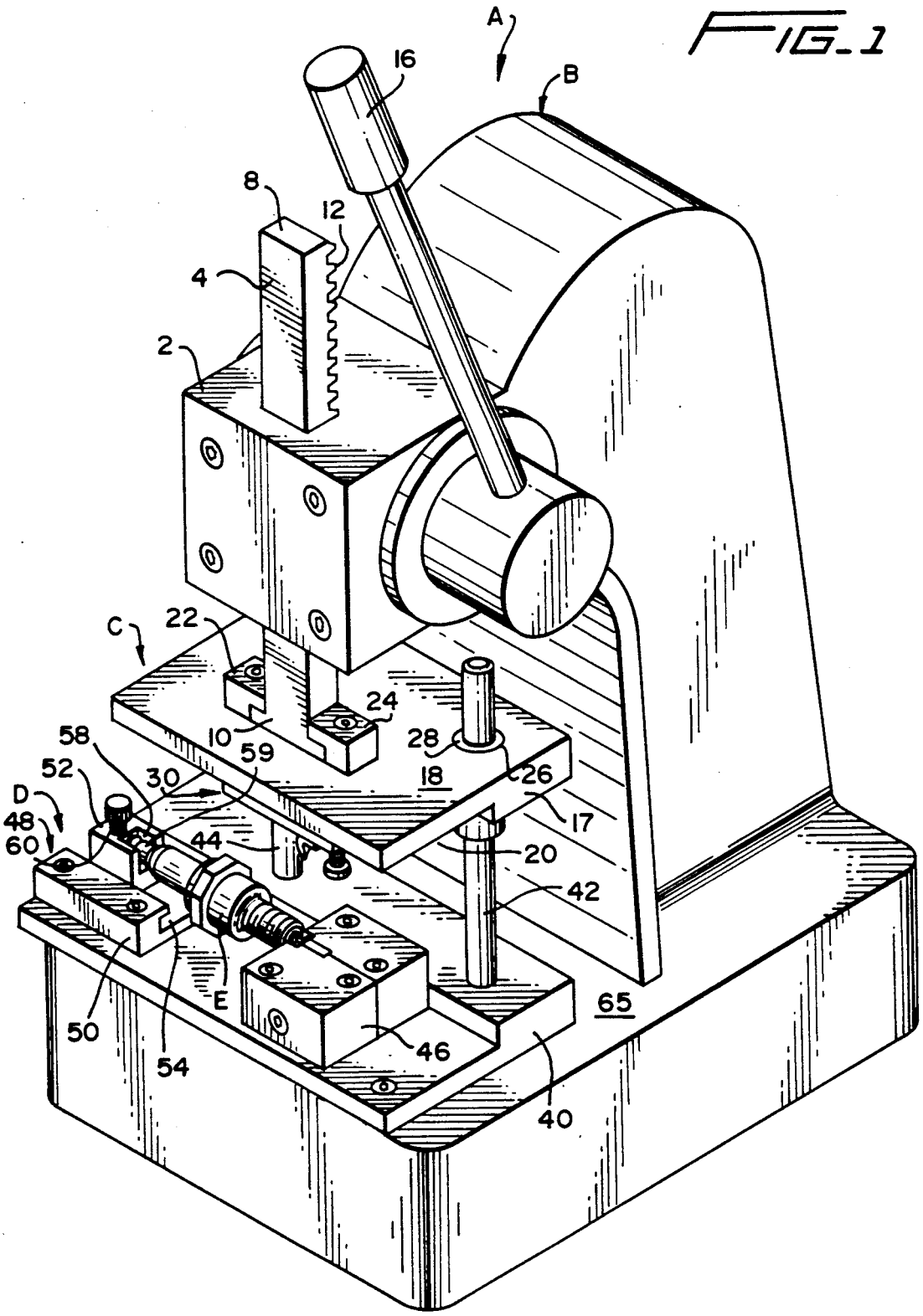
FIG. 1 is a perspective view of a preferred embodiment of the present invention.
Figure 2:
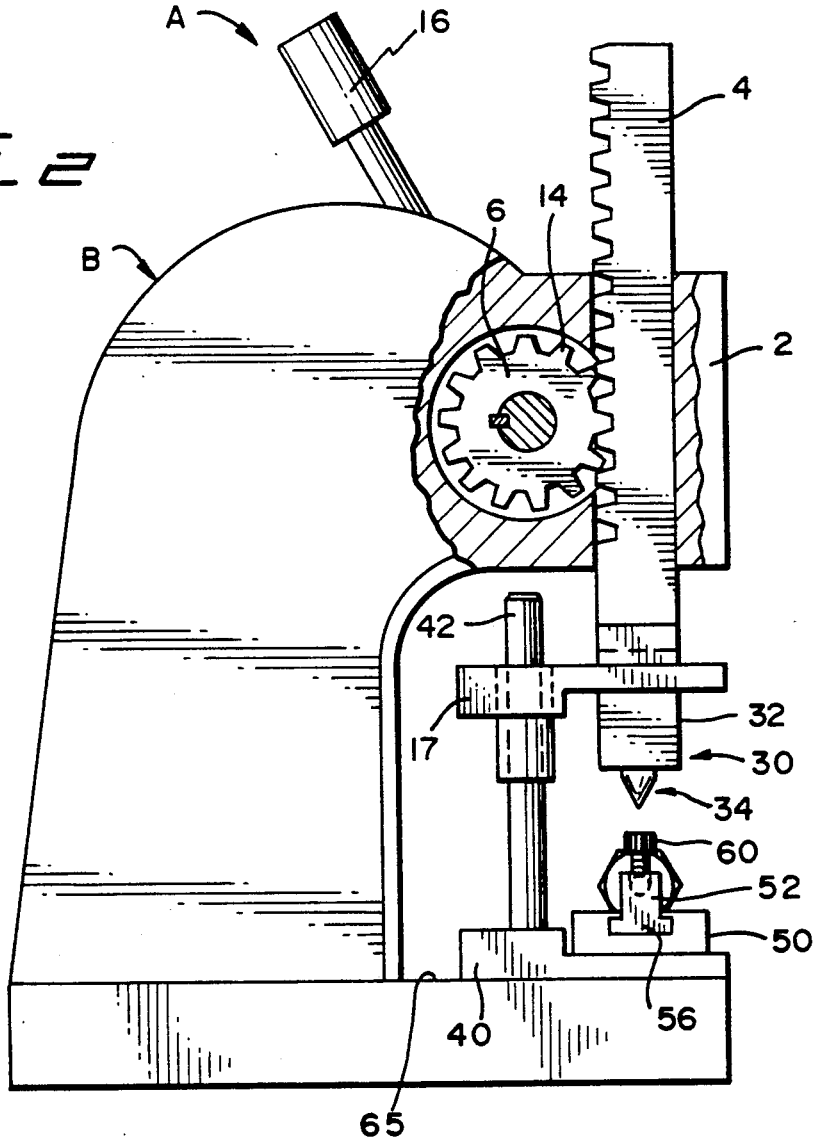
FIG. 2 is a fragmentary left side elevational view of the embodiment illustrated in FIG. 1.

Referring to FIG. 1, the spark plug forming device A includes a press B, a blade assembly C and spark plug supporting assembly D. The press B includes an operating head 2, a rack 4 and a pinion 6, as seen in FIG. 2. The rack 4 and pinion 6 are movably mounted in the operating head 2 in a conventional manner. The rack 4 includes a first end 8 and second end 10. A plurality of teeth 12 are formed intermediate the first end 8 and the second end 10. The pinion 6 includes a plurality of teeth 14 for meshing engagement with teeth 12 of rack 4. The second end 10 of rack 4 has a substantially T-shaped configuration for reasons which will be discussed below. An operating lever 16 is connected to the pinion 6 such that upon movement of the lever 16 pinion 6 rotates within the operating head 2. Rotation of pinion 6 will in turn cause the rack 4 to move in the vertical direction.

The blade assembly C includes a substantially L-shaped platform 17 having upper and lower surfaces 18 and 20, respectively. A pair of arms 22 and 24 are fixed to the upper surface 18 of the platform 17 to slidably receive the second end 10 of the rack 4. Openings 26 (only one of which is shown) extend from the upper surface 18 to the lower surface 20 of platform 17. Hollow collars 28 are disposed in each of the openings 26.

Figure 8:
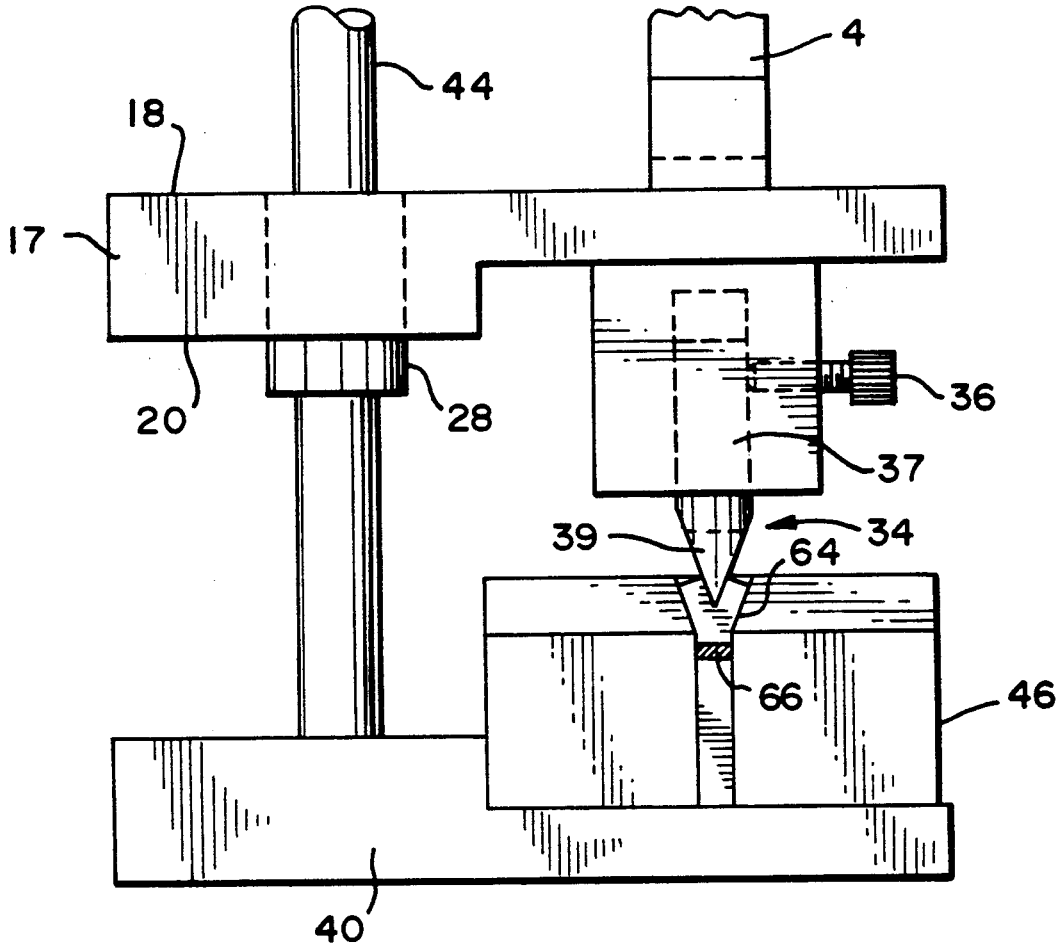
FIG. 8 is a fragmentary sectional view of the blade and spark plug supporting assemblies.

Referring to FIGS. 2, 5 and 8, a blade mounting unit 30 is fixed to the lower surface 20 of platform 17. The blade mounting unit 30 includes a body member 32 and a blade member 34 detachably secured to the body member 32 via screw 36, as best seen in FIG. 8. Therefore, it will be readily appreciated that blade member 34 may be removed and/or replaced by loosening screw 36. Blade member 34 includes a substantially cylindrical body portion 37 and a substantially V-shaped cutting head 39. As is readily seen in FIG. 5, the cutting head 39 extends across only a portion of the cylindrical body portion 37. Stop screw 38 is disposed adjacent the blade member 34 in a threaded opening formed in body member 32.

Figure 3:
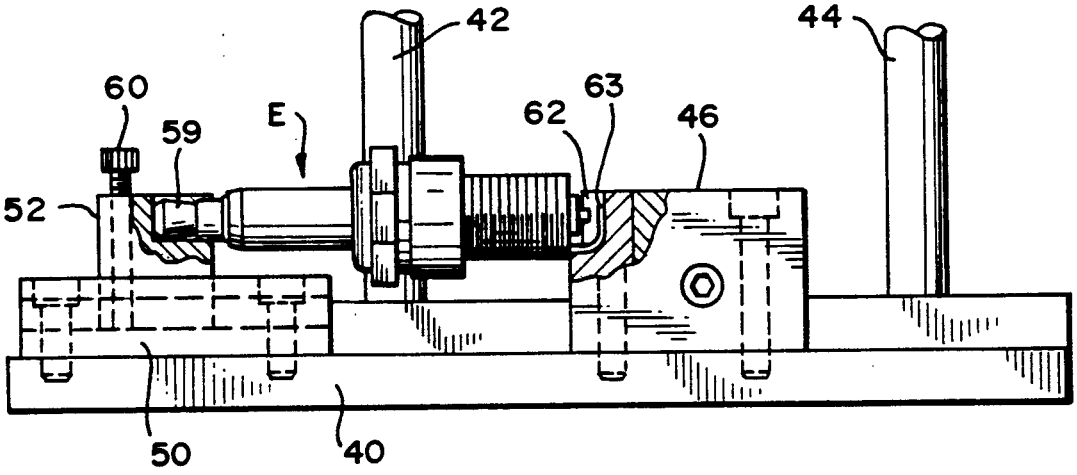
FIG. 3 is a fragmentary front elevational view of the spark plug supporting assembly.

The spark plug supporting assembly D includes a substantially L-shaped base 40 and a pair of rods 42 and 44 extending upwardly therefrom. The rods 42 and 44 extend through the hollow collars 28. The collars 28 each have an inner bearing surface to permit the collars 28 to slide on the corresponding rods 42 and 44. The spark plug supporting assembly D further includes a die 46 and an adjustable supporting member 48. The adjustable supporting member 48 includes guide element 50 and an adjustable support element 52. The guide element 50 includes a channel 54 for slidably receiving T-shaped end 56 of adjustable support element 52, as best shown in FIG. 2. The adjustable support element 52 further includes a substantially U-shaped recess 58 for receiving end 59 of the spark plug E. A screw 60 detachably secures the adjustable support element 52 to the guide element 50, as best shown in FIG. 3. Specifically, upon tightening of the screw 60, the adjustable support element 52 is fixed to the guide element 50. Similarly, upon loosening of the screw 60, the adjustable element 52 may be slidably displaced relative to the guide element 50.

Die 46 includes a recess 62 for receiving the ground electrode 63 of spark plug E, as seen in FIGS. 1 and 4. The upper portion 64 of recess 62 is V-shaped, as best seen in FIGS. 4 and 6. An arcuate member 66 bounds the recess 62 and has a shape corresponding to the shape of the ground electrode depicted in FIG. 9.

The base 40 may be detachably secured to lower face 65 of press B by conventional fasteners.

METHOD OF INVENTION

The preferred method of operating the device A will be described hereinafter with reference made to FIGS. 1 through 7.

Figure 9:
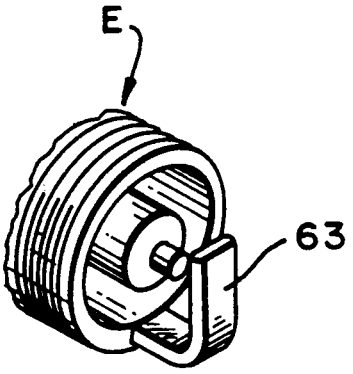
FIG. 9 is a fragmentary perspective view of a spark plug having a conventionally shaped ground electrode.
Figure 10:
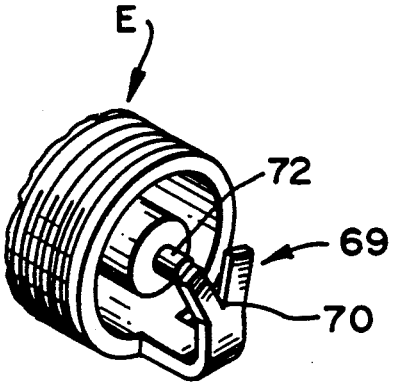
FIG. 10 is a fragmentary perspective view of a spark plug having a substantially V-shaped configuration formed in the gap-defining end of the ground electrode.

Referring to FIG. 1, the blade assembly C is depicted in the storage position, i.e. the blade member 34 is removed from the die 46. The adjustable support element 52 is positioned relative to the die 46 a distance substantially equal to the length of the spark plug E. Thus, by adjusting the element 52, the spark plug supporting assembly D can accommodate spark plugs of varying sizes. With the blade assembly in the position depicted in FIG. 1, the spark plug E having a ground electrode shaped in the manner illustrated in FIG. 9, is inserted into the spark plug supporting assembly D such that end 59 rests in recess 58 and ground electrode 63 rests in recess 62, as best shown in FIG. 3. Once the spark plug E is positioned as shown in FIG. 1, an operator depresses lever 16 causing pinion 6 to rotate thereby displacing rack 4 downwardly towards the spark plug E. Simultaneously, the blade assembly C is displaced an equal distance toward the spark plug E to an operating position depicted in FIG. 8. The cutting head 39 splits the ground electrode 63 into two prongs and the V-shaped upper portion 64 of recess 62 simultaneously forms the gap-defining end of the ground electrode 63 with a V-shaped configuration 69, as best seen in FIG. 10. The vertex 70 and its relationship to the center electrode 72 of the spark plug E is of great importance to the performance thereof for the reasons discussed in U.S. Pat. No. 4,916,354 which is incorporated herein by reference. The stop screw 38 is adjusted such that upon engagement with the die 46 the cutting head 37 has travelled a sufficient distance to form the vertex 70 in the desired location. Subsequently, the operator raises lever 16 and the spark plug E is removed from the spark plug supporting assembly D.

The present invention is a significant improvement over previously known devices for forming a V-shape in the gap-defining end of a ground electrode. More specifically, a conventional spark plug E may be inserted directly into the spark plug supporting assembly D without performing any bending steps prior thereto. Thus, a ground electrode of a conventional spark plug E can be readily modified to assume the form shown in FIG. 10 through the use of device A. Further, because the spark plug E is not positively secured to the supporting assembly D, it is not necessary to perform the tedious and time consuming tasks of adjusting clamping members and the like to either insert or remove the spark plug from spark plug supporting assembly D. This significantly expedites the process of modifying conventional spark plugs. The adjustable supporting element 48 permits the spark plug supporting assembly D to readily accommodate varying size plugs. Moreover, the device A may be readily disassembled into its component parts to facilitate servicing and/or storage of the same. In this regard, it is noted that the blade assembly C and spark plug supporting assembly D may be readily detached from the press B by sliding the same outwardly freeing arms 22 and 24 from the T-shaped end 10 of rack 4. Further, the blade C may be readily removed from the spark plug supporting assembly D by merely raising the assembly C a sufficient distance to pass over rods 42 and 44. By orienting the longitudinal axis of the spark plug E substantially perpendicular to the longitudinal axis of blade member 34 and providing arcuate member 66 with a profile corresponding to the conventionally shaped ground electrode, the present invention is able to significantly reduce undesirable deformation of the ground electrode during the splitting and shaping operation.

While this invention has been described as having a preferred design, it is understood that it is capable of further modifications, uses and/or adaptions of the invention following in general the principle of the invention including such departures from the present disclosure as come within the known or customary practice in the art to which the invention pertains, and as may be applied to central feature set forth and fall within the scope of the invention and the limits of the appended claims.

I claim:

1. An apparatus for forming a ground electrode of a spark plug having a longitudinal axis and a ground electrode having at least a first portion extending at an angle to the longitudinal axis, comprising:

a) spark plug supporting means for supporting a spark plug having a longitudinal axis such that at least a first portion of a ground electrode of the spark plug extends at an angle to the longitudinal axis; and, b) blade means operably associated with said spark plug supporting means for splitting the first portion of the ground electrode to form at least first and second prongs while the first portion extends at an angle to the longitudinal axis of the spark plug.

2. An apparatus as in claim 1, further including:

a) actuating means for displacing said blade means between a storage position removed form the first portion of the ground electrode and an operating position wherein the first portion is split into the first and second prongs.

3. An apparatus as in claim 2, wherein:

a) said actuating means is detachably connected to said blade means and said spark plug supporting means; and, b) said blade means is detachably connected to said spark plug supporting means.

4. An apparatus as in claim 2, wherein:

a) said actuating means includes a rack and pinion.

5. An apparatus as in claim 4, wherein:

a) said rack includes first and second ends, said second end being disposed adjacent said blade means, said second end has a substantially T-shaped configuration;

b) said blade means includes a pair of arms operably associated with said second end of said rack for detachably connecting said blade means to said actuating means.

6. An apparatus as in claim 1, wherein:

a) said blade means includes a blade member, said blade member is disposed substantially parallel to said first portion of the ground electrode and substantially perpendicular to the longitudinal axis of the spark plug; and, b) adjustable stop means for limiting movement of said blade member relative to the first portion of the ground electrode.

7. An apparatus as in claim 1, wherein:

a) said spark plug supporting means includes adjustment means for accommodating varying size spark plugs.

8. An apparatus as in claim 1, wherein:

a) said spark plug supporting means includes means for forming the first and second prongs of the ground electrode into a substantially V-shaped configuration; and, b) said forming means includes upper, lower, inner and outer surfaces, a first opening is formed in said upper surface for receiving said blade means and a second opening is formed in said inner surface for receiving the ground electrode.

9. An apparatus as in claim 8, wherein;

a) said forming means includes an arcuate member for supporting the ground electrode.

10. A method of forming a ground electrode of a spark plug, comprising the steps of:

a) providing a spark plug having a longitudinal axis and a ground electrode, the ground electrode including at least a first portion extending at an angle to the longitudinal axis of the spark plug;

b) providing spark plug supporting means for supporting the spark plug such that the first portion extends at an angle to the longitudinal axis of the spark plug;

c) providing blade means operably associated with the spark plug supporting means for splitting the first portion of the ground electrode to form at least first and second prongs;

d) providing actuating means for displacing the blade means between the first position removed from the first portion and a second position in which the first portion is split into at least first and second prongs; and, e) operating the actuating means to displace the blade means between the first and second positions while the first portion extends at an angle to the longitudinal axis of the spark plug.

11. A method as in claim 10, including the further steps of:

a) providing the blade means with a blade having a longitudinal axis; and, b) positioning the longitudinal axis of the blade substantially perpendicular to the longitudinal axis of the spark plug.

12. A method as in claim 10, including the further steps of:

a) providing the spark plug supporting means with first and second members each of which includes upper, lower, inner and outer surfaces;

b) providing an opening in each of the inner and upper surfaces of the first and second members.

13. A method as in claim 12, including the further step of:

a) providing means for adjusting the relative positions of the first and second members.

14. A method as in claim 10, including the further step of:

a) providing said blade means with an adjustable stop means for restricting movement of the blade means relative to the first portion of the ground electrode.

15. A method as in claim 10, including the further step of:

a) providing the spark plug supporting means with means for nonfixedly supporting the spark plug.

16. A method as in claim 10, including the further step of:

a) detachably connecting the blade means to the spark plug supporting means.

17. A method of forming a ground electrode of a spark plug, comprising the steps of:

a) providing a spark plug having a longitudinal axis and a ground electrode, the ground electrode including first and second portions;

b) providing spark plug supporting means for supporting the spark plug such that the second portion of the ground electrode extends substantially perpendicular to the first portion;

c) providing blade means operably associated with the spark plug supporting means for splitting the second portion of the ground electrode to form at least first and second prongs, the blade means including a longitudinal axis;

d) positioning the longitudinal axis of the blade means substantially perpendicular to the longitudinal axis of the spark plug;

e) providing actuating means for displacing the blade means between a first position removed from the second portion of the ground electrode and a second position in which the second portion is split into at least first and second prongs;

f) operating the actuating means to displace the blade means between the first and second positions while the second portion extends substantially perpendicular to the first portion of the ground electrode; and, g) forming the at least first and second prongs into a substantially V-shaped configuration.

18. A method as in claim 17, further including the step of:

a) positioning the blade means in substantially the center of the second portion of the ground electrode.

19. A method as in claim 18, further including the step of:

a) forming the first and second prongs of substantially equal size.

20. A method as in claim 17, including the further step of:

a) providing said blade means with an adjustable stop means for restricting movement of the blade means relative to the second portion of the ground electrode.

* * * * *